United States Patent [19]

Signori

[11] Patent Number: 4,882,858

[45] Date of Patent: Nov. 28, 1989

[54] BOOTS FOR MOTORCYCLE CROSS-COUNTRY RACING

[75] Inventor: Dino Signori, Maser, Italy

[73] Assignee: SIDI SPORT S.a.s. di Dino Signori & C., Maser, Italy

[21] Appl. No.: 192,765

[22] Filed: May 10, 1988

[30] Foreign Application Priority Data

Feb. 29, 1988 [IT] Italy ..... 20747/88[U]

[51] Int. Cl.[4] ..... A43B 7/32; A43B 5/14

[52] U.S. Cl. ..... 36/131; 36/133

[58] Field of Search ..... 36/43, 131, 133, 71, 36/77 R

[56] References Cited

U.S. PATENT DOCUMENTS

| | | | |
|---|---|---|---|
| 3,191,321 | 6/1965 | Brutting | 36/133 |
| 3,693,270 | 9/1972 | Murray | 36/71 |
| 4,019,266 | 4/1977 | Hanson et al. | 36/71 |
| 4,263,728 | 4/1981 | Frecentese | 36/29 |
| 4,345,387 | 8/1982 | Daswick | 36/29 |
| 4,587,749 | 5/1986 | Berlese | 36/131 |

FOREIGN PATENT DOCUMENTS

| | | | |
|---|---|---|---|
| 2813958 | 10/1979 | Fed. Rep. of Germany | 36/28 |
| 2827172 | 1/1980 | Fed. Rep. of Germany | 36/133 |
| 2310717 | 12/1976 | France | 36/131 |
| 2337515 | 8/1977 | France | 36/131 |
| 19967 | of 1898 | United Kingdom | 36/131 |

*Primary Examiner*—Steven N. Meyers

*Attorney, Agent, or Firm*—Birch, Stewart, Kolasch & Birch

[57] ABSTRACT

A boot for motorcycle cross-country racing is disclosed which comprises protection plates formed with plural elastically deformable hollow, button-like projections. The hollow, button-like projections extend through holes formed in a toe, malleolus and calf portions of said boot for attenuating shock transmitted to said boot.

6 Claims, 2 Drawing Sheets

BOOTS FOR MOTORCYCLE CROSS-COUNTRY RACING

BACKGROUND OF THE INVENTION

1. Field of the Invention

This invention relates to a motorcyclist boot particularly, but not exclusively, intended for use in motorcycle cross-country racing.

2. Description of Background Art

It is well-recognized that in the practice of potentially hazardous sports, such as hockey, motorcycling, American football, etc., the athlete is to be protected in the best possible way against the consequences of shocks and blows.

To that end, the relevant art has proposed a wide range of clothing articles and accessories also directed to provide protection for those regions of the human body which are most exposed to such blows.

Generally in motorcycling, and specifically in motorcycle cross-country racing, protection to a high standard is to be provided for the motorcyclist's legs, as being most vulnerable to blows and shocks which may be quite heavy.

It may also be appreciated that the regions of the leg which are most affected and in a reiterate manner are the calf and malleolus thereof, as well as the foot instep that when riding a motorcycle confronts the gearshift lever.

Protection for the foot and the above-mentioned leg portions is mainly ensured by specially designed boots, commonly referred to as "motorcross" boots.

To accomplish this, it is common practice with conventional boots for motorcycle cross-country racing to have rigid reinforcing plates attached to the boot uppers in the malleolus and calf areas thereof.

However, this prior art expedient has not only shown to be often inadequate to protect the leg against blows but also to significantly increase the boot weight and stiffness.

SUMMARY AND OBJECTS OF THE INVENTION

It is the main object of this invention to provide a boot for motorcycle cross-country racing which has such constructional and operational features as to obviate the above-noted shortcomings of the prior art.

This and other objects to become apparent hereinafter are achieved by a boot for motorcycle cross-country racing which comprises an upper having a malleolus and calf portion on both sides thereof, and is characterized in that it comprises at least one protection plate at at least one of said portions, said protection plate being provided with plural substantially button-like portions made of an elastically deformable material and jutting outwards from said boot.

BRIEF DESCRIPTION OF THE DRAWINGS

Further features and the advantages of this invention will be more clearly understood from the following detailed description of an embodiment thereof to be taken by way of illustration and not of limitation in conjunction with the accompanying drawings. In the drawings.

DETAILED DESCRIPTION OF THE PREFERRED EMBODIMENT

Figure 1:
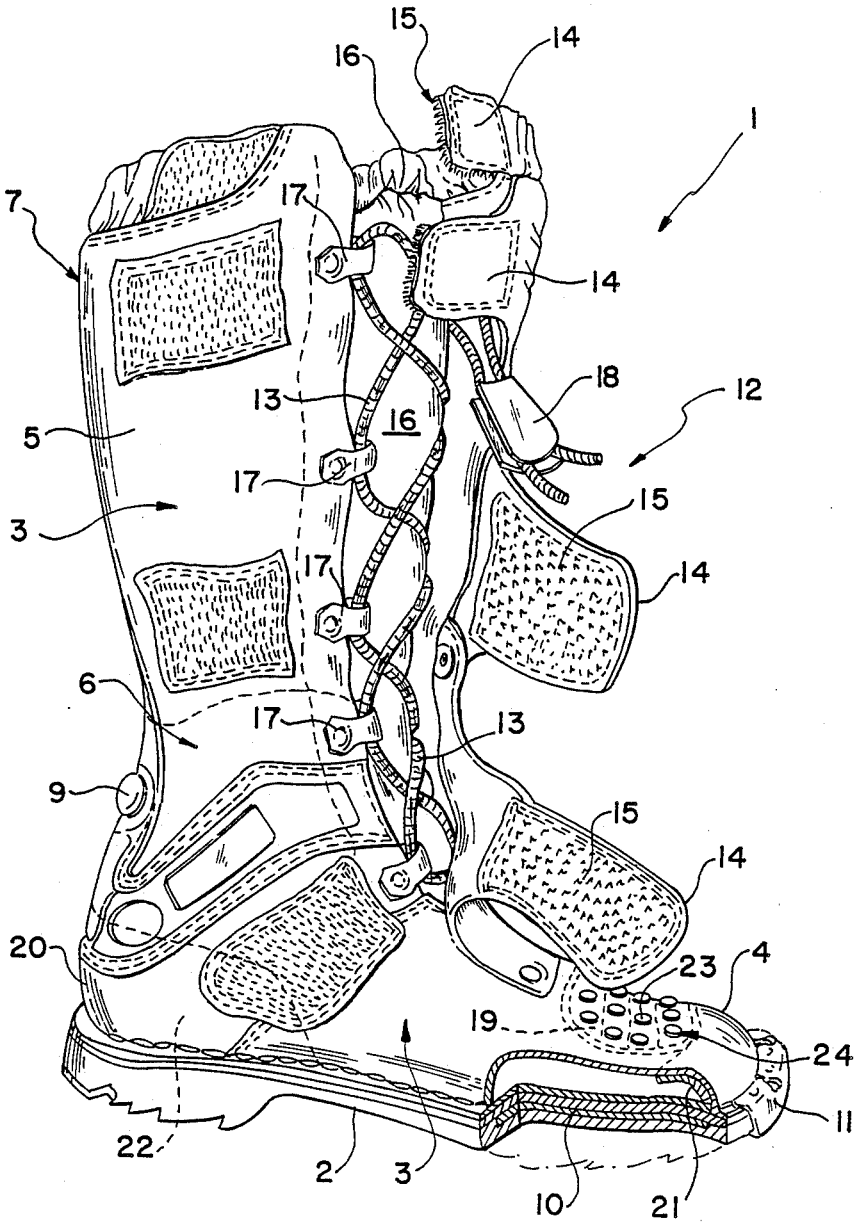
FIGS. 1 and 2 show in perspective and partial section, respectively, right and left specimens of the boot according to the invention.

With reference to the drawing views, the numeral 1 comprehensively designates a boot for motorcycle cross-country racing use, according to this invention.

The boot 1 comprises a sole 2 and an upper 3 provided with a toe portion 4 and a bootleg 5 having on either sides respective malleolus 6 and calf 7 portions.

Figure 2:
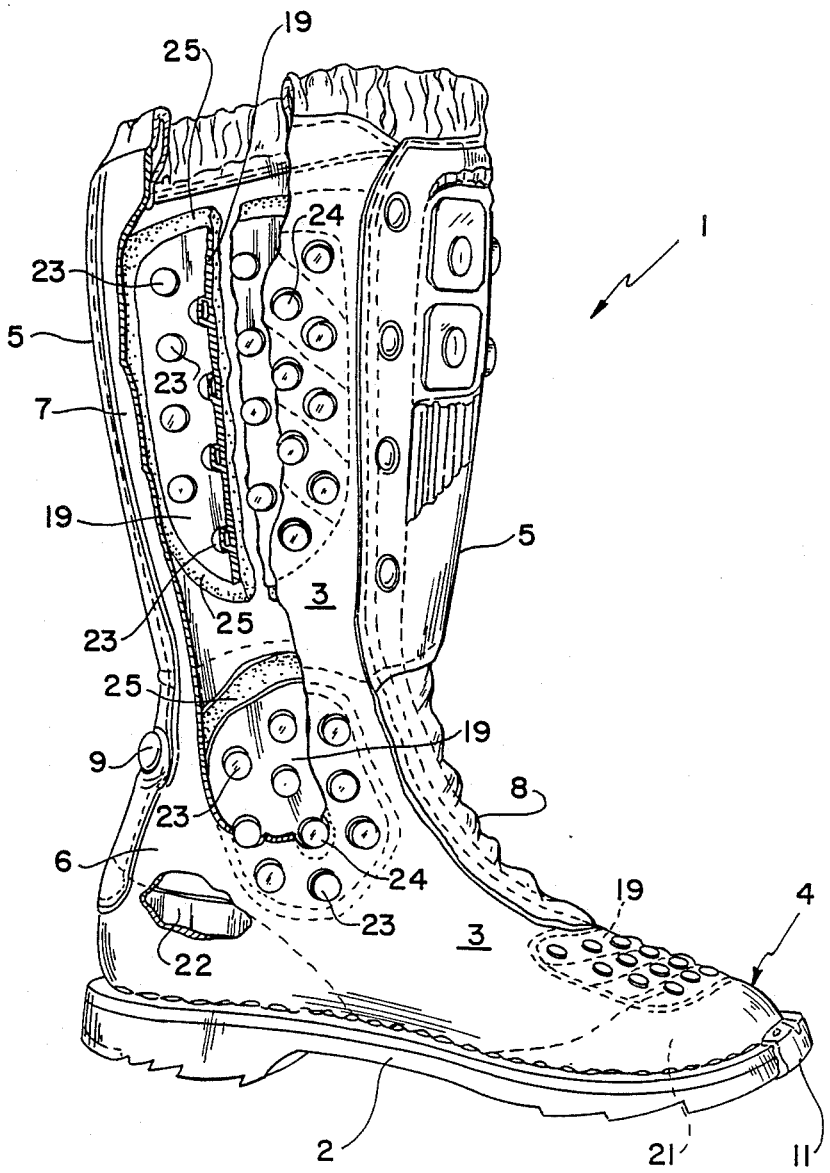

With reference to FIG. 2, it should be noted that in order to improve the boot flex while in use, the bootleg 5 is articulated to the toe portion 4 of the upper 3 by means of a pair of swivel mounts, respectively a forward mount 8 and a rearward mount 9.

The sole 2 comprises, embedded therein, a plate-like stiffening member, preferably made of steel, and is provided forwardly with a reinforcing metal toe piece 11.

The boot 1 further comprises a lacing arrangement 12 which includes a shoelace 13 and plurality of flaps 14 extending integrally from the upper 2 and supporting respective pull-up closure members 15.

With reference to FIG. 1, it should be noted that the lace 13 is guided to run on top of a large tongue 16, through a plurality of leaders 17 arranged in a zig-zag fashion along opposing end edges of said malleolus 6 and calf 7 portions of the bootleg 5. The lace 13, moreover, is locked releasingly in a boot fastening position by means of a cleat 18 acting on opposing end sections thereof.

The boot 1 further comprises, located at the toe 4, malleolus 6 and calf 7 portions, respective protection plates 19 which are secured in a conventional manner on the boot inside.

The plates 19 located over the malleolus 6 and calf 7 portions of the boot 1 are preferably provided on one side only thereof, in particular on the side to be in closer contact with the motorcycle.

To further improve the effectiveness of the protection afforded to the motorcyclist's foot, the boot 1 is provided internally, at one end of the toe portion 4 and at a heel portion 20 of the upper 3, with respective reinforcing rigid members 21,22.

In accordance with a characteristic feature of this invention, said plates 19 should be formed from an elastically deformable material (such as an elastomer) and provided with a plurality of substatially button-like portions 23 jutting outwards from the upper 2 through a corresponding plurality of holes 24 therethrough.

With reference to FIG. 2, it should be noted that the button-like portions 23, which extends integrally from the plates 19, are hollow internally and made of the same elastically deformable material as the plates.

By virtue of their hollow construction, the button-like portions 23 can yield to blows and, accordingly, provide an advantageous cushioning action.

The boot for motorcycle cross-country racing according to the invention, additionally to affording effective protection for the leg, can substantially attenuate shocks transmitted to it.

To enhance its protective action, lining plates 25 are advantageously provided inside the boot 1 which are formed preferably from some soft elastically deformable material (e.g., polyurethane foam) and attached (such as by cementing) to the plates 19.

The lining plates 25 being interposed to the protection plates 19 and the motorcyclist's leg and foot are not only effective to provide an additional shock cushioning effect but also to make the boot significantly more comfortable to wear.

A first, important advantage of the inventive boot is that the stresses transmitted to the leg in the practice of cross-country motorcycling are reduced substantially.

The button-like portions 23 can, in fact, yield compressively under a blow and therefore cushion the shocks received by an action which may be likened essentially to that of a shock-absorber.

The button-like portions 23 have, moreover, the added advantage of extending integrally from the protection plates 19; accordingly, they are apt to last longer because they can neither be detached nor strained as a result of the blows received while the boot is being used.

The peculiar construction, from an elastically deformable material, of the protection plates 19 also has an advantageous synergetic effect with the button-like portions 23 in providing effective cushioning of blows.

Lastly, the boot for cross-country motorcycling according to this invention has, in comparison with similar prior boots, the additional advantages of being lighter in weight and more compliant.

Understandably, the cross-country motorcycling boot just described may be variously modified and altered by a skilled person in the art for the purpose of meeting specific contingent demands, without departing from the spirit and scope of this invention as set forth in the appended claims.

I claim:

1. A boot for motorcycle cross-country racing comprising:

a sole portion;

an upper affixed to said sole portion, said upper including a toe portion;

a bootleg affixed to said upper, said bootleg including malleolus portions and calf portions disposed on both sides of said bootleg;

said toe, malleolus and calf portions being of a predetermined thickness;

a plurality of holes formed in discrete areas of said toe, malleolus and calf portions of said boot;

a plurality of protection plates mounted within the predetermined thickness of said toe, malleolus and calf portions of said boot and being disposed in the discrete areas adjacent to said plurality of holes; and a plurality of button-like, hollow portions constructed of an elastically deformable material projecting outwardly from said plurality of protection plates and through the plurality of holes in said discrete areas of said toe, malleolus and calf portions of said boot for attenuating shock transmitted to said boot.

2. The boot according to claim 1, wherein said protection plates are disposed in each of said malleolus and calf portions of said boot and each including a plurality of button-like, hollow portions constructed of an elastically deformable material projecting outwardly from said plurality of holes for attenuating shock transmitted to said boot.

3. The boot according to claim 1, and further including swivel mounts for articulately mounting said bootleg to said upper.

4. The boot according to claim 1, wherein said protection plates are formed of a deformable material.

5. The boot according to claim 4, wherein said deformable material is an elastomer.

6. The boot according to claim 1, and further including lining plates constructed of a soft elastically deformable material and being affixed to said protection plates on a side opposite to said plurality of button-like, hollow portions.

* * * * *